US009242355B2

(12) United States Patent
Sergyeyenko et al.

(10) Patent No.: US 9,242,355 B2
(45) Date of Patent: Jan. 26, 2016

(54) ILLUMINATED POWER TOOL

(75) Inventors: Oleksiy P. Sergyeyenko, Baldwin, MD (US); Keith D. Flaharty, Wrightsville, PA (US)

(73) Assignee: BLACK & DECKER INC., New Britain, CT (US)

( * ) Notice: Subject to any disclaimer, the term of this patent is extended or adjusted under 35 U.S.C. 154(b) by 857 days.

(21) Appl. No.: 13/448,459

(22) Filed: Apr. 17, 2012

(65) Prior Publication Data

US 2013/0271043 A1 Oct. 17, 2013

(51) Int. Cl.

| | |
|---|---|
| ***H05B 37/00*** | (2006.01) |
| ***B25B 21/00*** | (2006.01) |
| ***B25B 21/02*** | (2006.01) |
| ***B25B 23/18*** | (2006.01) |
| ***B25F 5/00*** | (2006.01) |

(52) U.S. Cl.

CPC ..... *B25B 21/00* (2013.01); *B25B 21/02* (2013.01); *B25B 23/18* (2013.01); *B25F 5/00* (2013.01)

(58) Field of Classification Search

CPC ..... B25B 21/00; B25B 23/18; B25F 5/00; B25F 5/021

See application file for complete search history.

(56) References Cited

U.S. PATENT DOCUMENTS

| | | | |
|---|---|---|---|
| 1,565,566 | A | 12/1925 | Hartley |
| 2,038,911 | A | 4/1936 | Stutz et al. |
| 2,242,536 | A | 5/1941 | Montgomery |
| 2,310,166 | A | 2/1943 | Way |
| 2,517,882 | A | 8/1950 | Johnson |
| 2,525,414 | A | 10/1950 | Kleinschmidt |
| 2,525,588 | A | 10/1950 | Cameron et al. |
| 2,702,649 | A | 2/1955 | Neilson |
| 2,730,263 | A | 1/1956 | Neilson |
| 2,736,792 | A | 2/1956 | Freeland |
| 2,773,974 | A | 12/1956 | Markett |
| 2,806,492 | A | 9/1957 | Becker |

(Continued)

FOREIGN PATENT DOCUMENTS

| | | | |
|---|---|---|---|
| DE | 1410234 | U | 5/1937 |
| DE | 689848 | C | 4/1940 |

(Continued)

OTHER PUBLICATIONS

"DB1ODL 10.8 Volt Lithium Ion Micro Driver Drill," Hitachi Power Tools, Hitachi Koki USA, Ltd.; internet: http://www.hitachipowertools.com/store_item.php?iID=611&arrPath=1,2,22,p611, p. 1-3.

(Continued)

*Primary Examiner* — Sibin Chen
(74) *Attorney, Agent, or Firm* — Stephen R. Valancius

(57) ABSTRACT

A power tool with a chuck and a tool body having a housing, a motor received in the housing, a light array mounted to the housing, and an output spindle extending through the light array and which is rotationally driven by the motor. The chuck has a chuck body, a plurality of jaws, and an outer sleeve. A rear end of the chuck body is rotatably mounted on the output spindle. The chuck body has a plurality of jaw apertures and a plurality of light holes. The jaw apertures and the light holes extend through a front surface of the chuck body. Each of the jaws is received in a corresponding one of the jaw apertures. The outer sleeve is disposed about the jaws and the chuck body. Light emanating from the light array is transmitted through the light holes to illuminate a zone in front of the chuck body.

9 Claims, 3 Drawing Sheets

(56) References Cited

U.S. PATENT DOCUMENTS

| | | | |
|---|---|---|---|
| 2,852,051 | A | 9/1958 | Bickner |
| 2,855,675 | A | 10/1958 | Kolthoff et al. |
| 2,855,679 | A | 10/1958 | Gibble |
| 3,109,238 | A | 11/1963 | Marks |
| 3,144,584 | A | 8/1964 | La Fiandra |
| 3,393,309 | A | 7/1968 | Leach et al. |
| 3,499,226 | A | 3/1970 | Hopkins |
| 3,561,462 | A | 2/1971 | Jugler |
| 3,595,132 | A | 7/1971 | Thacker |
| 3,603,782 | A | 9/1971 | Wortmann |
| 3,656,727 | A | 4/1972 | Greenlee |
| 3,681,627 | A | 8/1972 | Murry et al. |
| 3,729,658 | A | 4/1973 | Voitov |
| 3,919,541 | A | 11/1975 | Chao |
| 3,977,278 | A | 8/1976 | Jackson |
| 3,983,976 | A | 10/1976 | Taylor |
| 4,078,869 | A | 3/1978 | Honeycutt |
| 4,089,031 | A | 5/1978 | Stevens |
| 4,131,203 | A | 12/1978 | Bridges |
| 4,133,507 | A | 1/1979 | Chervenak |
| 4,160,570 | A | 7/1979 | Bridges |
| 4,246,506 | A | 1/1981 | Vartanian et al. |
| 4,330,274 | A | 5/1982 | Friedman et al. |
| 4,399,226 | A | 8/1983 | Danielson et al. |
| 4,429,463 | A | 2/1984 | Angell |
| 4,480,295 | A | 10/1984 | Shuster |
| 4,480,301 | A | 10/1984 | Pfaff et al. |
| 4,498,868 | A | 2/1985 | Schuss |
| 4,536,000 | A | 8/1985 | Rohm |
| 4,540,318 | A | 9/1985 | Hornung et al. |
| 4,611,716 | A | 9/1986 | Sorlien |
| 4,648,610 | A | 3/1987 | Hegyi |
| 4,678,922 | A | 7/1987 | Leininger |
| 4,703,850 | A | 11/1987 | Walker |
| 4,809,426 | A | 3/1989 | Takeuchi et al. |
| 4,833,782 | A | 5/1989 | Smith |
| 4,839,777 | A | 6/1989 | Janko et al. |
| 4,844,488 | A | 7/1989 | Flynn |
| 4,899,971 | A | 2/1990 | Elkin |
| 4,930,628 | A | 6/1990 | Bridges |
| 5,003,434 | A | 3/1991 | Gonser et al. |
| 5,061,885 | A | 10/1991 | Fukuhara |
| 5,068,652 | A | 11/1991 | Kobayashi |
| 5,133,455 | A | 7/1992 | Chow |
| 5,158,354 | A | 10/1992 | Simonin |
| 5,166,225 | A | 11/1992 | Asanuma et al. |
| 5,169,225 | A | 12/1992 | Palm |
| 5,267,129 | A | 11/1993 | Anderson |
| 5,276,595 | A | 1/1994 | Patrie |
| 5,313,527 | A | 5/1994 | Guberman et al. |
| 5,319,527 | A | 6/1994 | Murphy et al. |
| 5,406,300 | A | 4/1995 | Tokimoto et al. |
| 5,412,476 | A | 5/1995 | Marantette |
| 5,412,546 | A | 5/1995 | Huang |
| 5,427,002 | A | 6/1995 | Edman |
| 5,473,519 | A | 12/1995 | McCallops et al. |
| 5,477,434 | A | 12/1995 | Reed |
| 5,525,842 | A | 6/1996 | Leininger |
| 5,538,423 | A | 7/1996 | Coss et al. |
| 5,543,679 | A | 8/1996 | Morino et al. |
| 5,628,556 | A | 5/1997 | Hrabar et al. |
| 5,637,973 | A | 6/1997 | Hirai et al. |
| D380,952 | S | 7/1997 | Kim |
| 5,713,656 | A | 2/1998 | Lin |
| 5,720,542 | A | 2/1998 | Birge, Jr. et al. |
| 5,770,936 | A | 6/1998 | Hirai et al. |
| 5,793,130 | A | 8/1998 | Anderson |
| 5,797,670 | A | 8/1998 | Snoke et al. |
| 5,798,622 | A | 8/1998 | Hirai et al. |
| 5,801,454 | A | 9/1998 | Leininger |
| 5,818,188 | A | 10/1998 | Hirai et al. |
| 5,845,986 | A | 12/1998 | Breen |
| 5,873,647 | A | 2/1999 | Kurtz et al. |
| 5,913,596 | A | 6/1999 | Lin |
| 5,924,615 | A | 7/1999 | McGarrah |
| 5,970,616 | A | 10/1999 | Wahl et al. |
| 5,980,077 | A | 11/1999 | Shiao |
| 5,982,059 | A | 11/1999 | Anderson |
| 6,022,121 | A | 2/2000 | Lin |
| 6,028,694 | A | 2/2000 | Schmidt |
| 6,033,082 | A | 3/2000 | Lin |
| 6,033,087 | A | 3/2000 | Shozo et al. |
| 6,036,332 | A | 3/2000 | Antal |
| 6,050,698 | A | 4/2000 | Lee |
| 6,050,759 | A | 4/2000 | Bone |
| 6,067,714 | A | 5/2000 | Taylor et al. |
| 6,079,846 | A | 6/2000 | Huang |
| 6,086,217 | A | 7/2000 | Jau |
| 6,095,659 | A | 8/2000 | Hsu |
| RE36,917 | E | 10/2000 | Leininger |
| 6,126,295 | A | 10/2000 | Hillinger |
| 6,135,608 | A | 10/2000 | Lin |
| 6,145,995 | A | 11/2000 | Hung |
| 6,161,256 | A | 12/2000 | Quiring et al. |
| 6,168,287 | B1 | 1/2001 | Liu |
| 6,168,301 | B1 | 1/2001 | Martinez et al. |
| 6,178,081 | B1 | 1/2001 | Armond et al. |
| 6,179,433 | B1 | 1/2001 | Shiao |
| 6,183,103 | B1 | 2/2001 | Hillinger |
| 6,206,538 | B1 | 3/2001 | Lemoine |
| 6,213,620 | B1 | 4/2001 | Huang et al. |
| 6,224,229 | B1 | 5/2001 | Lin |
| 6,237,767 | B1 | 5/2001 | Lee |
| 6,238,058 | B1 | 5/2001 | Lin |
| 6,243,240 | B1 | 6/2001 | Ozue et al. |
| 6,257,077 | B1 | 7/2001 | Patterson |
| 6,260,979 | B1 | 7/2001 | Lin |
| 6,260,980 | B1 | 7/2001 | Ping |
| 6,280,047 | B1 | 8/2001 | Chen |
| 6,283,607 | B1 | 9/2001 | Lin |
| D449,506 | S | 10/2001 | Haung |
| 6,318,874 | B1 | 11/2001 | Matsunaga |
| 6,318,875 | B1 | 11/2001 | Hrabar et al. |
| 6,322,177 | B1 | 11/2001 | Vasudeva |
| 6,364,033 | B1 | 4/2002 | Hung et al. |
| 6,401,996 | B1 | 6/2002 | Thom et al. |
| 6,443,675 | B1 | 9/2002 | Kopras et al. |
| 6,454,429 | B1 | 9/2002 | Liao |
| 6,467,577 | B1 | 10/2002 | Charlebois, Jr. |
| 6,478,442 | B2 | 11/2002 | Chen |
| 6,494,590 | B1 | 12/2002 | Paganini et al. |
| 6,497,494 | B1 | 12/2002 | Lin |
| 6,501,199 | B2 | 12/2002 | Hung |
| 6,502,947 | B2 | 1/2003 | Matsumoto et al. |
| 6,502,949 | B1 | 1/2003 | Horiyama et al. |
| 6,511,200 | B2 | 1/2003 | Matsunaga |
| 6,511,201 | B1 | 1/2003 | Elrod |
| 6,565,227 | B1 | 5/2003 | Davis |
| 6,575,590 | B1 | 6/2003 | Wadsworth |
| 6,616,295 | B2 | 9/2003 | Sako et al. |
| 6,617,737 | B1 | 9/2003 | Minalga et al. |
| 6,622,537 | B2 | 9/2003 | Rodriguez |
| 6,644,825 | B2 | 11/2003 | Lin |
| 6,663,260 | B1 | 12/2003 | Tieszen |
| 6,694,631 | B2 | 2/2004 | Bone et al. |
| 6,713,905 | B2 | 3/2004 | Hirschburger et al. |
| 6,725,945 | B2 | 4/2004 | Sugimoto et al. |
| 6,729,743 | B2 | 5/2004 | Gillette |
| D493,345 | S | 7/2004 | Allison |
| 6,803,683 | B2 | 10/2004 | Bone et al. |
| 6,810,596 | B2 | 11/2004 | Fung et al. |
| 6,814,461 | B2 | 11/2004 | Minalga |
| 6,814,480 | B2 | 11/2004 | Amano |
| 6,822,357 | B2 | 11/2004 | Hung |
| 6,857,756 | B2 | 2/2005 | Reiff et al. |
| 6,863,544 | B2 | 3/2005 | Haehn et al. |
| 6,868,967 | B2 | 3/2005 | Lam |
| RE38,729 | E | 4/2005 | Liu |
| 6,886,961 | B2 | 5/2005 | Hara et al. |
| 6,890,135 | B2 | 5/2005 | Kopras et al. |
| 6,899,451 | B2 | 5/2005 | Kittelmann et al. |
| 6,905,015 | B2 | 6/2005 | Hernandez, Jr. et al. |
| 6,905,221 | B2 | 6/2005 | Hsu |
| 6,916,106 | B2 | 7/2005 | Xingguo |

(56) References Cited

U.S. PATENT DOCUMENTS 6,918,331 B2 7/2005 Okouchi
6,921,235 B2 7/2005 Chen
6,939,022 B2 9/2005 Brooks
6,960,867 B2 11/2005 Dupont et al.
6,961,190 B1 11/2005 Tamaaki et al.
6,964,545 B1 11/2005 Languasco
6,979,100 B2 12/2005 Reiff et al.
6,979,104 B2 12/2005 Brass et al.
6,991,105 B2 1/2006 Winnard
7,006,306 B2 2/2006 Falicoff et al.
7,007,762 B2 3/2006 Yamamoto
7,025,485 B2 4/2006 Henry
7,029,142 B2 4/2006 Chen et al.
7,053,325 B2 5/2006 Yuasa et al.
7,054,411 B2 5/2006 Katcha et al.
7,069,662 B2 7/2006 Fung et al.
7,080,964 B2 7/2006 Riley et al.
7,090,372 B2 8/2006 Liao et al.
7,093,951 B2 8/2006 Tsuruta et al.
7,094,011 B2 8/2006 Kopras et al.
7,095,142 B2 8/2006 Leininger
7,101,058 B2 9/2006 Prell et al.
7,137,761 B2 11/2006 Hara et al.
7,147,411 B2 12/2006 Astakhov et al.
7,152,329 B2 12/2006 Kondo et al.
7,185,998 B2 3/2007 Oomori et al.
7,188,966 B1 3/2007 Lin
7,195,428 B2 3/2007 Astakhov et al.
7,197,113 B1 3/2007 Katcha et al.
7,200,516 B1 4/2007 Cowley
7,204,606 B2 4/2007 Brass et al.
7,228,983 B2 6/2007 Pangerc et al.
7,249,862 B2 7/2007 Shirane
7,253,541 B2 8/2007 Kovarik et al.
7,258,230 B2 8/2007 Hernandez, Jr. et al.
7,278,751 B2 10/2007 Chang et al.
7,282,818 B2 10/2007 Kovarik
7,296,905 B2 11/2007 Etter et al.
D557,099 S 12/2007 Lin
7,303,007 B2 12/2007 Konschuh et al.
7,307,230 B2 12/2007 Chen
7,318,485 B2 1/2008 Greese et al.
7,331,113 B1 2/2008 Patrick et al.
7,331,685 B2 2/2008 Shen et al.
7,339,323 B2 3/2008 Bucur
7,357,526 B2 4/2008 Zeiler
7,395,876 B1 7/2008 Walker
7,404,696 B2 7/2008 Campbell
7,483,220 B2 1/2009 Kittelmann et al.
7,498,526 B2 3/2009 Lohr et al.
7,510,296 B2 3/2009 Nevin
7,552,781 B2 6/2009 Zhang et al.
7,559,427 B2 7/2009 Hu
7,568,288 B2 8/2009 Baker
7,568,816 B2 8/2009 Brass et al.
7,600,885 B2 10/2009 Canino et al.
7,654,178 B2 2/2010 Hall et al.
7,677,752 B2 3/2010 Tadokoro et al.
7,681,659 B2 3/2010 Zhang et al.
7,682,035 B2 3/2010 Wuensch et al.
7,682,036 B2 3/2010 Reiff et al.
7,703,950 B2 4/2010 Ewert et al.
7,705,482 B2 4/2010 Leininger
7,717,619 B2 5/2010 Katcha et al.
7,726,863 B2 6/2010 Brandstaetter et al.
7,728,464 B2 6/2010 Leininger
7,736,009 B2 6/2010 Quattrini
7,740,369 B2 6/2010 Gabriel et al.
7,815,356 B2 10/2010 Lutz et al.
7,824,136 B2 11/2010 Campbell
7,850,325 B2 12/2010 Wall et al.
7,866,839 B2 1/2011 Chien
7,926,187 B2 4/2011 Uehlein-Proctor et al.
7,934,847 B2 5/2011 Oomori et al.
8,016,048 B2 9/2011 Ueda et al.
8,042,966 B2 10/2011 Lutz et al.
8,075,155 B2 12/2011 Watanabe et al.
8,091,650 B2 1/2012 Van der Linde et al.
8,317,350 B2 11/2012 Friedman et al.
8,328,381 B2 12/2012 Dixon et al.
8,360,593 B2 1/2013 Kim et al.
8,382,308 B2 2/2013 Hecht et al.
8,529,084 B2 9/2013 Roehm
9,028,088 B2 5/2015 Vanko et al.
2002/0054491 A1 5/2002 Casas
2002/0131267 A1 9/2002 Van Osenbruggen
2002/0136021 A1 9/2002 Hung
2002/0154499 A1 10/2002 Hsieh
2002/0172035 A1 11/2002 Hara et al.
2002/0179437 A1 12/2002 Ko
2002/0197123 A1 12/2002 Kopras et al.
2003/0058637 A1 3/2003 Hsien
2003/0194283 A1 10/2003 Kovarik et al.
2003/0202851 A1 10/2003 Kovarik
2004/0084342 A1 5/2004 Chang
2004/0156190 A1 8/2004 Tsuruta et al.
2005/0044728 A1 3/2005 Baker
2005/0047878 A1 3/2005 Riley et al.
2005/0085124 A1 4/2005 Kristen et al.
2005/0111214 A1 5/2005 Zeiler
2005/0135800 A1 6/2005 Nguyen et al.
2005/0152131 A1 7/2005 Shirane
2005/0157260 A1 7/2005 Graham et al.
2005/0157489 A1 7/2005 Oomori et al.
2005/0157849 A1 7/2005 Radley et al.
2005/0185300 A1 8/2005 Kittelmann et al.
2005/0188550 A1 9/2005 Uehlein-Proctor et al.
2005/0199522 A1 9/2005 Hu
2005/0218023 A1 10/2005 Winnard
2005/0221664 A1 10/2005 Winnard
2005/0247585 A1 11/2005 Breckwoldt et al.
2005/0248933 A1 11/2005 Chen et al.
2005/0261870 A1 11/2005 Cramer et al.
2006/0104085 A1 5/2006 Walker et al.
2006/0104732 A1 5/2006 Huang
2006/0113930 A1 6/2006 Andriolo
2006/0157260 A1 7/2006 Greese et al.
2006/0176682 A1 8/2006 Wu et al.
2006/0180327 A1 8/2006 Nagasaka et al.
2006/0234846 A1 10/2006 Tucker
2006/0243105 A1 11/2006 Delfini et al.
2006/0250057 A1 11/2006 Vasudeva
2006/0262519 A1 11/2006 Hirschburger et al.
2006/0289595 A1 12/2006 Shen et al.
2007/0046110 A1 3/2007 Liu
2007/0138971 A1 6/2007 Chen
2007/0159812 A1 7/2007 Oomori et al.
2007/0193039 A1 8/2007 Onose et al.
2007/0239233 A1* 10/2007 Klein ..... 607/88
2008/0025017 A1 1/2008 Tadokoro et al.
2008/0041746 A1 2/2008 Hsiao
2008/0060847 A1 3/2008 Konschuh et al.
2008/0068827 A1 3/2008 Chang
2008/0074865 A1 3/2008 Lutz et al.
2008/0144309 A1 6/2008 Nagata et al.
2008/0149678 A1 6/2008 Huang
2008/0150439 A1 6/2008 Bucur
2008/0158861 A1 7/2008 Chiang
2008/0215056 A1 9/2008 Miller et al.
2008/0244910 A1 10/2008 Patel
2008/0264212 A1 10/2008 Leupert
2008/0266841 A1 10/2008 Gabriel et al.
2008/0271906 A1 11/2008 Walker
2008/0278931 A1 11/2008 Wu et al.
2008/0314795 A1 12/2008 Lin
2009/0013477 A1 1/2009 Agronin et al.
2009/0077814 A1 3/2009 Gibbons et al.
2009/0077816 A1 3/2009 Gibbons et al.
2009/0077817 A1 3/2009 Gibbons et al.
2009/0077819 A1 3/2009 Kuehne et al.
2009/0080987 A1 3/2009 Canino et al.
2009/0123817 A1 5/2009 Stickel et al.
2009/0128062 A1 5/2009 Watanabe et al.
2009/0134710 A1 5/2009 Tyndall et al.

(56) References Cited

U.S. PATENT DOCUMENTS

| | | | | |
|---|---|---|---|---|
| 2009/0141482 | A1 | 6/2009 | Wall et al. | |
| 2009/0145259 | A1 | 6/2009 | Wall et al. | |
| 2009/0159677 | A1 | 6/2009 | Yakimov et al. | |
| 2009/0200961 | A1 | 8/2009 | Straub | |
| 2009/0207035 | A1 | 8/2009 | Watanabe et al. | |
| 2009/0256319 | A1 | 10/2009 | Seymour et al. | |
| 2009/0309519 | A1 | 12/2009 | Suzuki et al. | |
| 2009/0313831 | A1 | 12/2009 | Patel | |
| 2010/0000094 | A1 | 1/2010 | Lombardo | |
| 2010/0002415 | A1 | 1/2010 | Munn et al. | |
| 2010/0008079 | A1 | 1/2010 | Brass et al. | |
| 2010/0038103 | A1 | 2/2010 | Ueda et al. | |
| 2010/0043603 | A1 | 2/2010 | McRoberts et al. | |
| 2010/0053940 | A1 | 3/2010 | Yaksich | |
| 2010/0071921 | A1 | 3/2010 | Canino et al. | |
| 2010/0072833 | A1 | 3/2010 | Canino et al. | |
| 2010/0074700 | A1 | 3/2010 | Canino et al. | |
| 2010/0089601 | A1 | 4/2010 | Fukinuki et al. | |
| 2010/0148505 | A1 | 6/2010 | Dunlap et al. | |
| 2010/0149790 | A1 | 6/2010 | Leong | |
| 2010/0208497 | A1* | 8/2010 | Song et al. | 362/619 |
| 2010/0214768 | A1 | 8/2010 | Dixon et al. | |
| 2010/0242695 | A1 | 9/2010 | Xu et al. | |
| 2010/0277897 | A1 | 11/2010 | Hecht et al. | |
| 2010/0315804 | A1 | 12/2010 | Nishikimi et al. | |
| 2010/0328929 | A1 | 12/2010 | Lutz et al. | |
| 2010/0328969 | A1 | 12/2010 | Meyer | |
| 2011/0017473 | A1 | 1/2011 | Clarkson et al. | |
| 2011/0040235 | A1 | 2/2011 | Castel | |
| 2011/0058356 | A1 | 3/2011 | Friedman et al. | |
| 2011/0170312 | A1 | 7/2011 | Parrinello | |
| 2011/0188232 | A1* | 8/2011 | Friedman et al. | 362/119 |
| 2011/0197458 | A1 | 8/2011 | Karrar et al. | |
| 2011/0248650 | A1* | 10/2011 | Sterling et al. | 315/307 |
| 2012/0236545 | A1 | 9/2012 | Van Der Linde et al. | |
| 2012/0243225 | A1 | 9/2012 | Lee et al. | |
| 2013/0021783 | A1 | 1/2013 | Vanko et al. | |

FOREIGN PATENT DOCUMENTS

| | | | |
|---|---|---|---|
| DE | 6806826 | U | 3/1969 |
| DE | 1808818 | A1 | 6/1970 |
| DE | 2529668 | A1 | 1/1977 |
| DE | 7704943 | U1 | 6/1977 |
| DE | 2819691 | A1 | 11/1979 |
| DE | 3003703 | A1 | 8/1980 |
| DE | 8529779 | U1 | 12/1985 |
| DE | 3525352 | A1 | 1/1987 |
| DE | 3831344 | A1 | 3/1990 |
| DE | 8912224 | U1 | 12/1990 |
| DE | 4202223 | A1 | 9/1992 |
| DE | 4229282 | A1 | 5/1993 |
| DE | 4336730 | A1 | 5/1995 |
| DE | 4420999 | A1 | 12/1995 |
| DE | 29709437 | U1 | 9/1997 |
| DE | 29719020 | U1 | 12/1997 |
| DE | 29807070 | U1 | 6/1998 |
| DE | 29818802 | U1 | 1/1999 |
| DE | 29907922 | U1 | 8/1999 |
| DE | 10119010 | A1 | 10/2002 |
| DE | 20215382 | U1 | 3/2003 |
| DE | 20201300 | U1 | 7/2003 |
| DE | 20310541 | U1 | 9/2003 |
| DE | 10315980 | A1 | 11/2003 |
| DE | 10246772 | A1 | 4/2004 |
| DE | 202004019853 | U1 | 2/2005 |
| DE | 10340178 | B3 | 4/2005 |
| DE | 10356384 | A1 | 6/2005 |
| DE | 102004011575 | A1 | 9/2005 |
| DE | 202007010340 | U1 | 10/2007 |
| DE | 102006045157 | A1 | 4/2008 |
| DE | 102006049925 | A1 | 4/2008 |
| DE | 202008003787 | U1 | 6/2008 |
| DE | 202008016901 | U1 | 3/2009 |
| DE | 102011075663 | A1 | 11/2012 |
| DE | 102011077440 | A1 | 12/2012 |
| DE | 102011077441 | A1 | 12/2012 |
| DE | 102011077442 | A1 | 12/2012 |
| DE | 102011077443 | A1 | 12/2012 |
| DE | 102011077444 | A1 | 12/2012 |
| DE | 102011077451 | A1 | 12/2012 |
| EP | 0280527 | A2 | 8/1988 |
| EP | 1068934 | A1 | 1/2001 |
| EP | 1072842 | A2 | 1/2001 |
| EP | 1125698 | A2 | 8/2001 |
| EP | 1287948 | A2 | 3/2003 |
| EP | 1477282 | A1 | 11/2004 |
| EP | 1690649 | A1 | 8/2006 |
| EP | 1693162 | A2 | 8/2006 |
| EP | 2199024 | A1 | 6/2010 |
| EP | 2223783 | A1 | 9/2010 |
| FR | 667849 | A | 10/1929 |
| GB | 2041189 | A | 9/1980 |
| GB | 2041798 | A | 9/1980 |
| GB | 2305128 | A | 4/1997 |
| GB | 2375497 | A | 11/2002 |
| GB | 2407058 | A | 4/2005 |
| JP | S6460447 | A | 3/1989 |
| JP | 3138168 | A | 6/1991 |
| JP | 5309508 | A | 11/1993 |
| JP | 06246645 | A | 9/1994 |
| JP | 8252778 | A | 10/1996 |
| JP | 9239672 | A | 9/1997 |
| JP | 10034564 | A | 2/1998 |
| JP | 10034565 | A | 2/1998 |
| JP | 10034566 | A | 2/1998 |
| JP | 11111002 | A | 4/1999 |
| JP | 3079279 | B2 | 8/2000 |
| JP | 2002166374 | A | 6/2002 |
| JP | 2002307325 | A | 10/2002 |
| JP | 2002307330 | A | 10/2002 |
| JP | 2003033901 | A | 2/2003 |
| JP | 2003211374 | A | 7/2003 |
| JP | 2004174667 | A | 6/2004 |
| JP | 2006218583 | A | 8/2006 |
| JP | 2009214239 | A | 9/2009 |
| JP | 2010207972 | A | 9/2010 |
| WO | WO-9902310 | A2 | 1/1999 |
| WO | WO-03061915 | A1 | 7/2003 |
| WO | WO-2005018855 | A1 | 3/2005 |
| WO | WO-2006015909 | A1 | 2/2006 |
| WO | WO-2008133339 | A1 | 11/2008 |
| WO | WO-2009080404 | A1 | 7/2009 |
| WO | WO-2009138269 | A1 | 11/2009 |
| WO | WO-2010034566 | A1 | 4/2010 |

OTHER PUBLICATIONS

"Eluminate Series," Makita, internet: http://www.makita.com/tools_item_view.asp?Id=638.
Print-off from unknown website.
Photographs of disassembled tools currently being sold.
Hitachi brochure. Date unknown.
Photographs of a partly disassembled currently sold Bosch tool.
Printouts of tools from websites. Website and date unknown.
Photocopies of brochures. Dated as marked.
David, Radu—European Search Report re EP 12 17 7787—Oct. 22, 2013—4 pp—The Hague.
David, Radu—European Search Report re EP 13 17 6802—Oct. 22, 2013—6 pp—The Hague.

* cited by examiner

ILLUMINATED POWER TOOL

FIELD

The present disclosure relates to an illuminated power tool.

BACKGROUND

This section provides background information related to the present disclosure which is not necessarily prior art.

Power tools are often used in a variety of conditions ranging from well-lit indoor work spaces to outside construction sites or other areas that are not always well-lit. Accordingly, it is desirable to provide a method or apparatus that permits a power tool to have a lighting feature that will illuminate the workpiece that is being machined or worked on by the power tool. Such a lighting feature will assist a user to be able to adequately see the workpiece or work area that is being worked on or machined by the power tool even in substandard light conditions.

SUMMARY

This section provides a general summary of the disclosure, and is not a comprehensive disclosure of its full scope or all of its features.

In one form, the present teachings provide a power tool that includes a tool body and a chuck. The tool body has a housing, a motor received in the housing, a light array mounted to the housing, and an output spindle extending through the light array and which is rotationally driven by the motor. The chuck has a chuck body, a plurality of jaws, and an outer sleeve. A rear end of the chuck body is fixedly mounted on the output spindle for common rotation with the output spindle about a rotational axis of the chuck. The chuck body has a plurality of jaw apertures and a plurality of light holes. The jaw apertures and the light holes extend through a front surface of the chuck body. Each of the jaws is received in a corresponding one of the jaw apertures. The outer sleeve is disposed about the jaws and the chuck body. Light emanating from the light array is transmitted through the light holes to illuminate a zone located in front of the chuck body.

In another form, the present teachings provide a power tool that includes a tool body, a chuck and an illuminating means. The tool body has an output spindle and a motor for driving the output spindle. The chuck is coupled to the output spindle for rotation therewith. The illuminating means is configured to illuminate a zone in front of the chuck.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
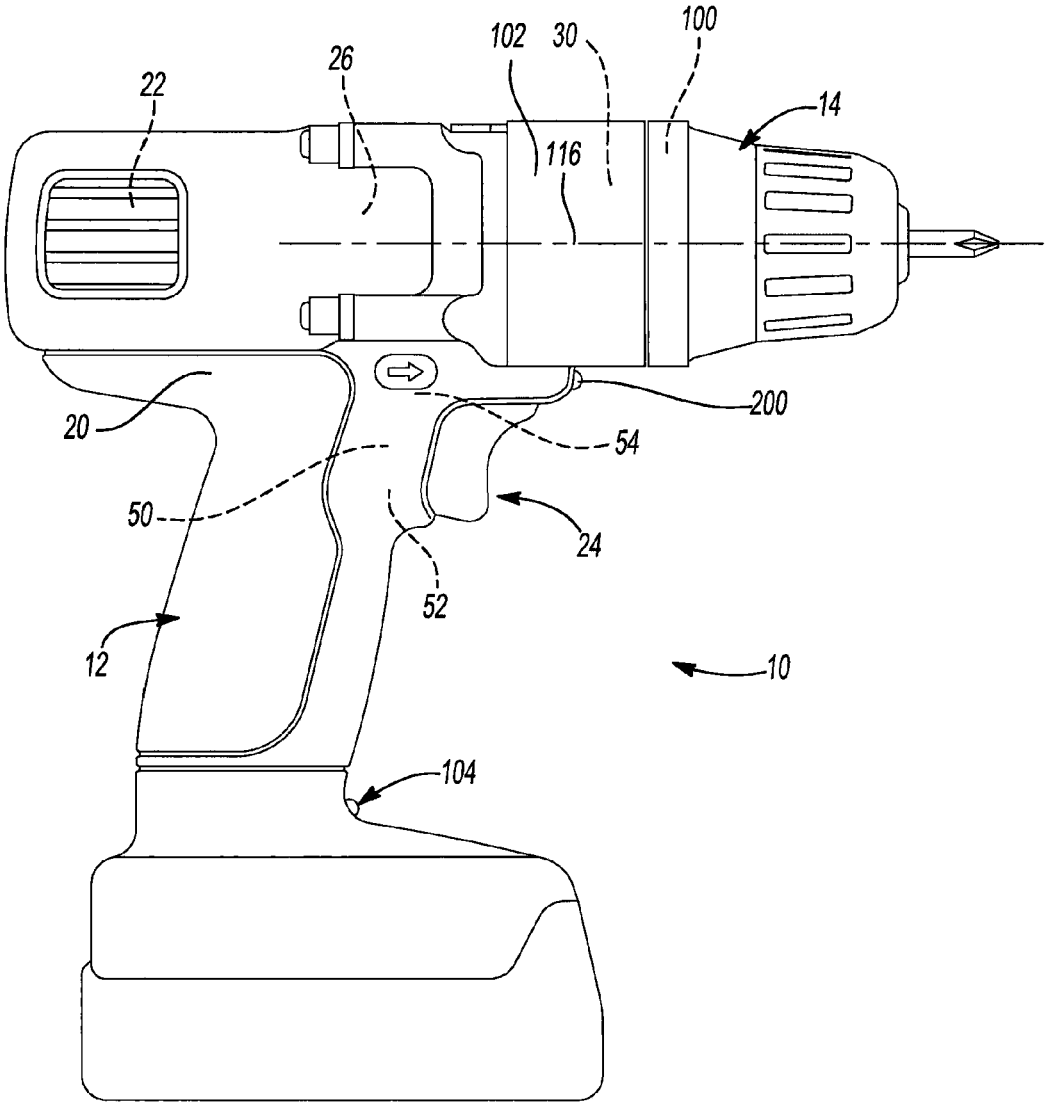
FIG. 1 is a side elevation view of an exemplary power tool constructed in accordance with the teachings of the present disclosure.

With reference to FIG. 1 of the drawings, an exemplary power tool constructed in accordance with the teachings of the present disclosure is generally indicated by reference numeral 10. The power tool 10 can include a tool body 12 and a chuck 14. The tool body 12 can be any type of tool having a rotary output that is suited to drive the chuck 14, such as a hammer/drill driver, a rotary impact/driver or a hammer/rotary impact/driver. In the particular example provided, the tool body 12 is a drill/driver. Except as described herein, the tool body 12 can be configured as a conventional drill driver similar to the drill/drivers disclosed in U.S. Pat. No. 6,431,289 and U.S. Patent Application Publication No. 2010/0163261, the disclosures of which are incorporated by reference as if fully set forth in detail herein.

Figure 2:
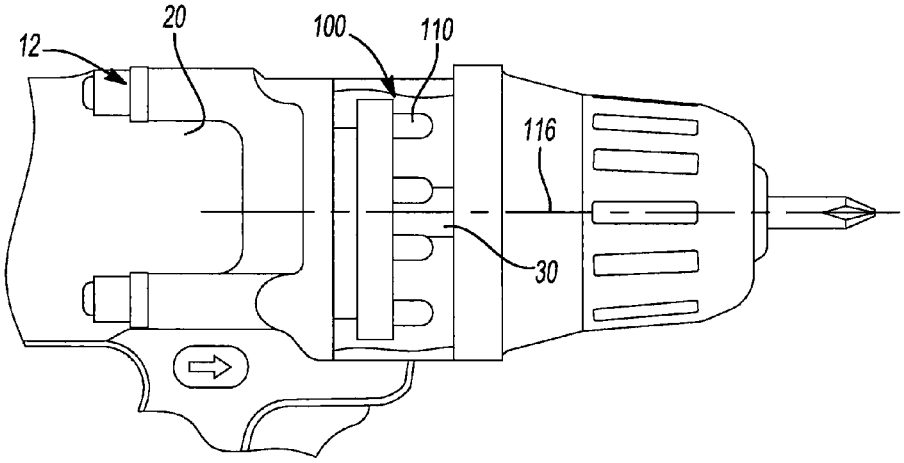
FIG. 2 is an enlarged view of a portion of the power tool of FIG. 1 with a shroud removed to better illustrate a light array.

With reference to FIGS. 1 and 2, the tool body 12 can comprise a housing 20, a motor 22, a trigger assembly 24, a transmission 26, and an output spindle 30. As those of skill in the art will appreciate, the housing 20 can house the motor 22, the trigger assembly 24 and the transmission 26. The motor 24 can be any type of electric motor, such as a brushed DC electric motor. The trigger assembly 24 can couple the motor 22 to a source of electrical power, such as a battery pack (not shown). The trigger assembly 24 can comprise a trigger controller 50, a trigger switch 52 and a trigger direction switch 54. The trigger controller 50 can conventionally direct power from the source of electrical power to the motor 22 in response to signals received from the trigger switch 52 and the trigger direction switch 54. The transmission 26 can be any type of transmission that can be employed to provide a speed reduction and torque multiplication function. In the particular example provided, the transmission 26 is a three-stage, two-speed transmission. It will be appreciated, however, that the transmission 26 may include more or fewer stages, and may be configured to provide more or fewer speed ratios. If desired, a clutch assembly (not shown) or a suitable control algorithm can be configured to limit rotary power that is transmitted between the transmission 26 and the output spindle 30.

Additionally, the tool body 12 includes a light array 100, a shroud 102, and a light array switch 104. With additional reference to FIG. 3, the light array 100 can comprise one or more light sources 110 that can be mounted to a front end of the housing 20. In the particular example provided, the light array 100 comprises six light emitting diodes that are arranged concentrically about a rotational axis 116 of the output spindle 30. The shroud 102 can be configured to house the light array 100 and to cover an axial space (best shown in FIG. 3) between the light array 100 and the chuck 14. The light array switch 104 can be any type of switch for coupling the light array to the source of electric power. In the particular example provided, the light array switch 104 is a normally open momentary switch that permits the transmission of electrical energy (from the power source to the light array 100) when the light array switch 104 is activated (depressed) and inhibits the transmission of electrical energy when the light array switch 104 is deactivated (released). It will be appreciated that other types of switches, such as a toggle switch, may be employed in lieu of a momentary switch, and that other control elements, such as a timer, may be integrated in to the circuit that supplies electrical power to the light array 100.

Figure 3:
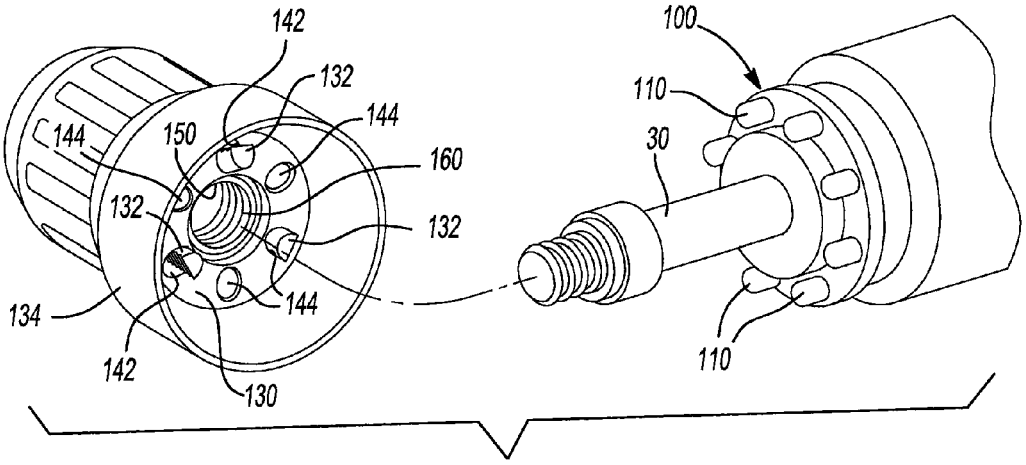
FIG. 3 is an exploded perspective view of a portion of the power tool of FIG. 1 with the shroud removed to better illustrate the light array and a light hole formed in a chuck body of a chuck.
Figure 4:
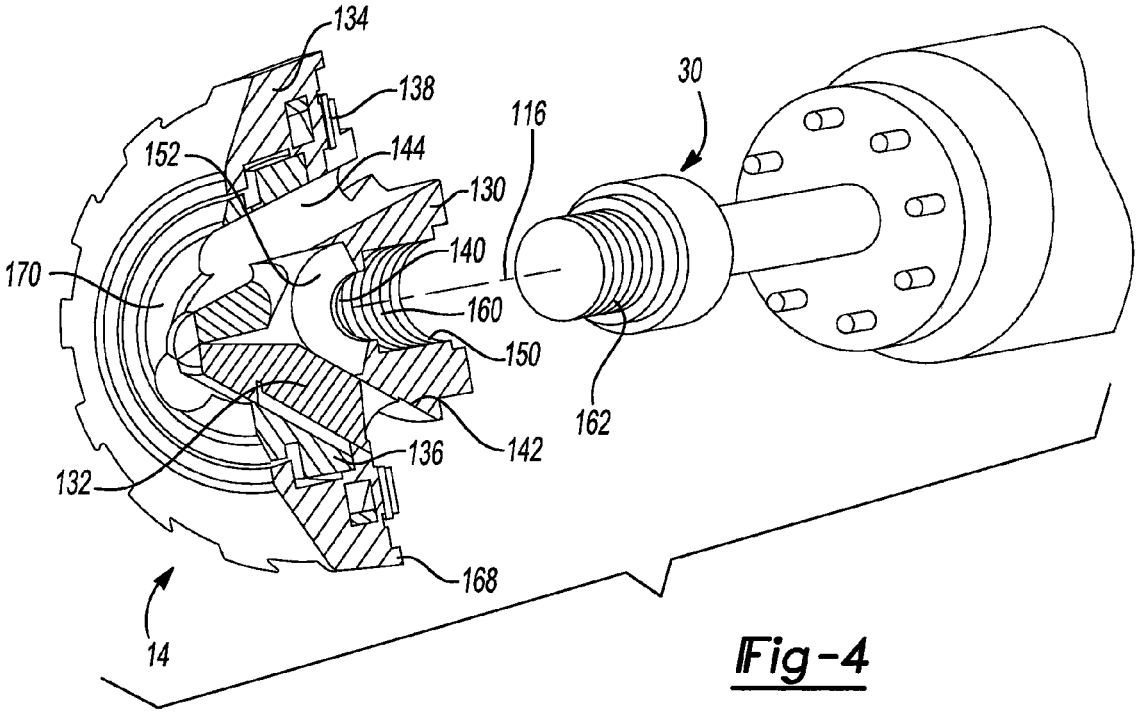
FIG. 4 is an exploded longitudinal section view of a portion of power tool of FIG. 1 illustrating the chuck and an output spindle.

With reference to FIGS. 3 and 4, the chuck 14 can be any type of chuck, such as a keyed or keyless chuck. In the particular example provided, the chuck 14 is a keyless chuck and includes a chuck body 130, a plurality of jaws 132, a sleeve member 134, a split nut 136, and a thrust bearing assembly 138. The chuck body 130 can be a generally cylindrical structure having a central cavity 140, a plurality of jaw apertures 142, and a plurality of light holes 144. The central cavity 140 can include a first cavity portion 150 and a second cavity portion 152. The first cavity portion 150 can include a female threaded portion 160 that can be sized to threadably engage mating threads 162 formed on the output spindle 30 of the tool body 12 (FIG. 1) such that a rear end 168 of the chuck body 130 and the output spindle 30 are coupled to one another for common rotation. The second cavity portion 152 can be configured to receive a bit (not shown) between the jaws 132. The jaw apertures 142 can be configured to receive the jaws 62. The jaw apertures 142 can be inclined relative to the rotational axis 116 and can extend through a front surface 170 of the chuck body 130. The light holes 144 can be inclined relative to the rotational axis 116 such that the light holes 144 approach the rotational axis 116 with increasing distance from the rear end 168 of the chuck 14. The light holes 144 can be formed through the front surface 170 of the chuck body 130 and can be configured to facilitate the transmission of light emanating from the light array 100 to a zone in front of the front surface 170 of the chuck body 130. It will be appreciated that the light array 100 can comprise a first quantity (N) of light sources 110 and that the chuck body 130 can have a second quantity (n) of light holes 144 and that the first quantity (N) and the second quantity (n) could be set in a desired manner. For example, the first quantity (N) could be set greater than the second quantity (n), or the first quantity (N) could be greater than or equal to twice the second quantity (n). In the particular example provided, the first quantity (N) is equal to six (i.e., there are six light sources 110 in the light array 100) and the second quantity (n) is equal to three (i.e., there are three light holes 144 in the chuck body 130). Each of the jaws 132 can be received in an associated one of the jaw apertures 142. The sleeve member 134 can be rotatably received over the chuck body 130 and the jaws 132. The split nut 136 can have a plurality of threads (not specifically shown) that are threadably engaged to threaded surfaces (not specifically shown) on the jaws 132. The split nut 136 can be coupled to the sleeve member 134 for common rotation and in the particular example provided, the split nut 136 is press-fit into the sleeve member 134. The thrust bearing assembly 138 can be received axially between the sleeve member 134 and the chuck body 130 (or a component that is fixedly coupled to the chuck body 130).

With reference to FIGS. 1, 2 and 4, when the power tool 10 is to be operated, a user may depress the light array switch 104 to illuminate the light array 100. Light emanating from the light source(s) 110 can be transmitted through the shroud 102 and against the rear end 168 of the chuck 14. It will be appreciated that some of the light generated by the light array 100 will be transmitted through the light holes 144 and upon exiting the chuck body 130, will illuminate a zone located in front of the chuck body 130. The light array 100 can remain in an activated (i.e., light generating) state until the light array switch 104 is released. Alternatively, the light array 100 can be deactivated upon the occurrence of one or more predetermined conditions (e.g., the lapsing of a predetermined time increment). Also alternatively, the light array 100 could be activated through operation of the trigger switch 52 (i.e., so that the light array 100 and the motor 22 are operated via a common switch).

In some situations it may be desirable to equip the power tool 10 with additional lighting capabilities. In the particular example provided, the tool body 12 includes a work light 200 that is located vertically between the trigger assembly 24 and the chuck 14. The work light 200 can be activated in any manner desired, such as a dedicated switch or via the trigger switch 52.

Figure 5:
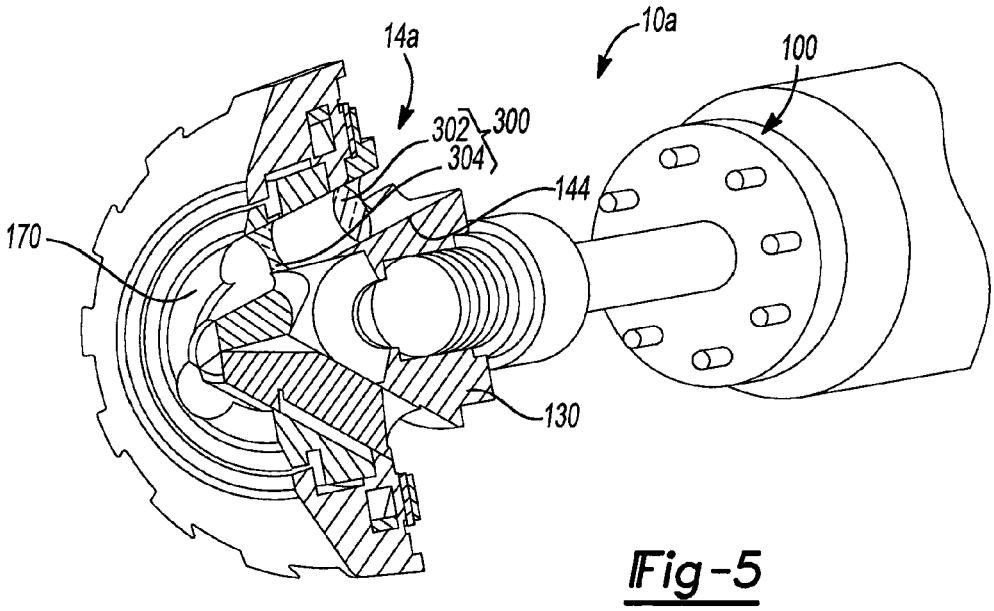
FIG. 5 is a longitudinal section view of a portion of a second power tool constructed in accordance with the teachings of the present disclosure.

With reference to FIG. 5, an additional example of a power tool constructed in accordance with the teachings of the present disclosure is indicated by reference numeral **10*a*. The power tool 10*a* is generally similar to the power tool 10 of FIG. 1, except that the chuck 14*a* further includes at least one optical element 300 received in each of the light holes 144. In the particular example provided, the at least one optical element 300 comprises a rear optical element 302 and a front optical element 304. Each of the rear optical elements 302 can be a lens that is configured to focus light that is directed from the light array 100 (FIG. 2) into a respective one of the light holes 144, while each of the front optical elements 304 can be a lens that is configured to spread light that is exiting a respective one of the light holes 144. The front optical elements 304 can be positioned axially within the light holes 144 rearwardly of the front surface 170 of the chuck body 130 so as to reduce the risk that the front optical elements 304 would be damaged if the front surface 170 rubs against another object when the power tool 10*a* is operated. It will be appreciated that it is not necessary to use both rear and front optical elements 302 and 304 (i.e., together) and that it may be desirable in some situations to use only rear optical elements 302 or only front optical elements 304. It will also be appreciated that while the front and rear optical elements 302 and 304 have been described and illustrated as being discrete components, the front and rear optical elements 302 and 304 could be formed on a monolithic optical element (e.g., on the opposite ends of a plastic cylinder). Moreover, it will be appreciated that the front and rear optical elements 302 and 304** could be any type of optical element (including an optical element with parallel planar surfaces.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A power tool comprising:

a tool body having a housing, a motor received in the housing, a light array mounted to the housing, and an output spindle extending through the light array and rotationally driven by the motor; and a chuck having a chuck body, a plurality of jaws, and an outer sleeve, a rear end of the chuck body being fixedly mounted on the output spindle for common rotation with the output spindle about a rotational axis, the chuck body having a plurality of jaw apertures and a plurality of light holes, the jaw apertures and the light holes extending through a front surface of the chuck body, each of the jaws being received in a corresponding one of the jaw apertures, the outer sleeve being disposed about the jaws and the chuck body, wherein light emanating from the light array is transmitted through the light holes to illuminate a zone located in front of the chuck body.

2. The power tool of claim 1, wherein the light holes are inclined relative to the rotational axis.

3. The power tool of claim 1, wherein the light array comprises a plurality of light sources.

4. The power tool of claim 3, wherein the light array has a first quantity (N) of the light sources, wherein the chuck body has a second quantity (n) of light holes, and wherein the first quantity (N) is greater than the second quantity (n).

5. The power tool of claim 4, wherein the first quantity (N) is greater than or equal to twice the second quantity (n).

6. The power tool of claim 1, wherein the chuck is a keyless chuck.

7. The power tool of claim 1, wherein the light array is selectively operable through actuation of a dedicated switch mounted to the tool body.

8. The power tool of claim 1, wherein the chuck further comprises at least one optical element received in each of the light holes.

9. The power tool of claim 8, wherein the at least one optical element comprises a lens.

* * * * *